US008105095B2

(12) United States Patent
Yeh

(10) Patent No.: US 8,105,095 B2
(45) Date of Patent: Jan. 31, 2012

(54) ELECTRICAL CONNECTOR ASSEMBLY

(75) Inventor: Cheng-Chi Yeh, Tu-Cheng (TW)

(73) Assignee: Hon Hai Precision Ind. Co., Ltd., New Taipei (TW)

( * ) Notice: Subject to any disclaimer, the term of this patent is extended or adjusted under 35 U.S.C. 154(b) by 260 days.

(21) Appl. No.: 12/549,392

(22) Filed: Aug. 28, 2009

(65) Prior Publication Data

US 2010/0055946 A1 Mar. 4, 2010

(30) Foreign Application Priority Data

Sep. 1, 2008 (TW) ..... 097215668

(51) Int. Cl.
*H01R 12/00* (2006.01)

(52) U.S. Cl. ..... 439/83; 439/331

(58) Field of Classification Search ..... 439/83, 439/73, 331

See application file for complete search history.

(56) References Cited

U.S. PATENT DOCUMENTS

| | | | | |
|---|---|---|---|---|
| 6,916,195 | B2 * | 7/2005 | Byquist | 439/342 |
| 7,402,065 | B1 * | 7/2008 | Polnyi | 439/331 |
| 7,473,121 | B2 * | 1/2009 | Fan et al. | 439/342 |
| 7,553,178 | B1 * | 6/2009 | Wertz et al. | 439/331 |
| 2008/0070426 | A1 | 3/2008 | Ma | |

* cited by examiner

*Primary Examiner* — Tulsidas C Patel
*Assistant Examiner* — Travis Chambers
(74) *Attorney, Agent, or Firm* — Ming Chieh Chang; Wei Te Chung; Andrew C. Cheng

(57) ABSTRACT

An electrical connector assembly, for electrically connecting an IC package and a printed circuit board (PCB) (1), comprises an insulative housing (2); an insulator (4) separated with the insulative housing, and comprising a bottom surface and a guiding portion (42) extending downwardly from the bottom surface; a shell (3) covering the insulative housing, and one end of the shell assembled on the insulator; a PCB comprising a retaining hole (11) for receiving the guiding portion of the insulator, and the bottom surface of the insulator attached to the PCB.

13 Claims, 6 Drawing Sheets

ELECTRICAL CONNECTOR ASSEMBLY

BACKGROUND OF THE INVENTION

1. Field of the Invention

The present invention relates to an electrical connector assembly, and particularly to an electrical connector assembly for electrically connecting an IC package and a printed circuit board (PCB).

2. Description of Prior Art

An electrical connector connecting an IC package to a PCB is described in U.S. Patent Publication No. 2008/0070426, which was published on Mar. 20, 2008. The connector comprises an insulative housing, a number of contacts received in the housing, a stiffener coupled with the housing and a cover respectively mounted on the stiffener. The stiffener defines a number of through holes, and an insulative standoff is retained in each through hole to avoid the metal stiffener contacting with the PCB electrically. When the connector is assembled on the PCB, the through hole should be communicate with a screw hole of the PCB. However, it is very difficult to accurately position the connector on the PCB without a guiding device. Another disadvantage is that the electrical connector may rotate around a screw when the screw assembled to the through hole and the screw hole, and the connector needs to be re-located.

Hence, it is desirable to have an improved electrical connector assembly to overcome the above-mentioned disadvantages of the prior art.

BRIEF SUMMARY OF THE INVENTION

Accordingly, the object of the present invention is to provide an electrical connector assembly, which could be located on a PCB accurately.

In order to achieve the above-mentioned object, an electrical connector assembly comprises a PCB defining at least one retaining hole and an electrical connector. The electrical connector comprises an insulative housing, a plurality of contacts received in the insulative housing, an insulator sandwiched between the insulative housing and the PCB. The insulator comprises a bottom surface and a guiding portion extending downwardly from the bottom surface. The guiding portion is received in the at least one retaining hole of the PCB when the connector is assembled to the PCB.

Other objects, advantages and novel features of the invention will become more apparent from the following detailed description of the present embodiment when taken in conjunction with the accompanying drawings.

DETAILED DESCRIPTION OF THE INVENTION

Referring to FIG. 1 to FIG. 6, an electrical connector assembly in accordance with the present invention is for electrically connecting an IC package (not shown) and a printed circuit board (PCB) 1. The PCB 1 comprises a plurality of through holes, each through hole comprises a retaining hole 11 and a screw hole 12 located at the bottom of the retaining hole 11, the retaining hole 11 communicates with the screw hole 12, and the diameter of the retaining hole 11 is bigger than the diameter of the screw hole 12.

Referring to FIG. 1 to FIG. 6, an electrical connector assembly in accordance with the present invention is for electrically connecting an IC package (not shown) and a printed circuit board (PCB) 1. The PCB 1 comprises a plurality of through holes, each through hole comprises a retaining hole 11 and a screw hole 12 located at the bottom of the retaining hole 11, the retaining hole 11 communicates with the screw hole 12, and the diameter of the retaining hole 12 is smaller than the diameter of the screw hole 11.

Figure 1:
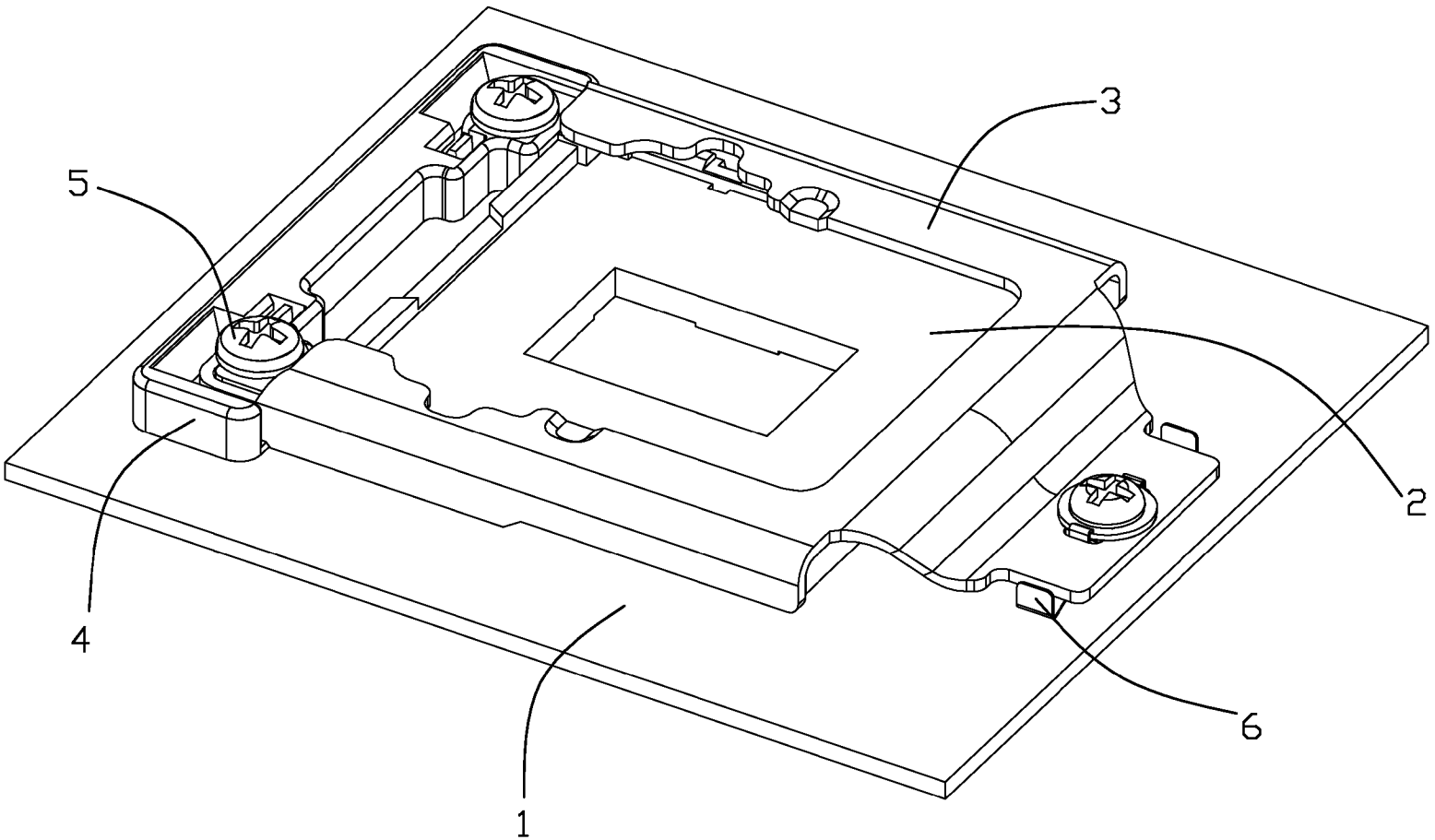
FIG. 1 is a perspective view of an electrical connector assembly in accordance with the present invention.
Figure 2:
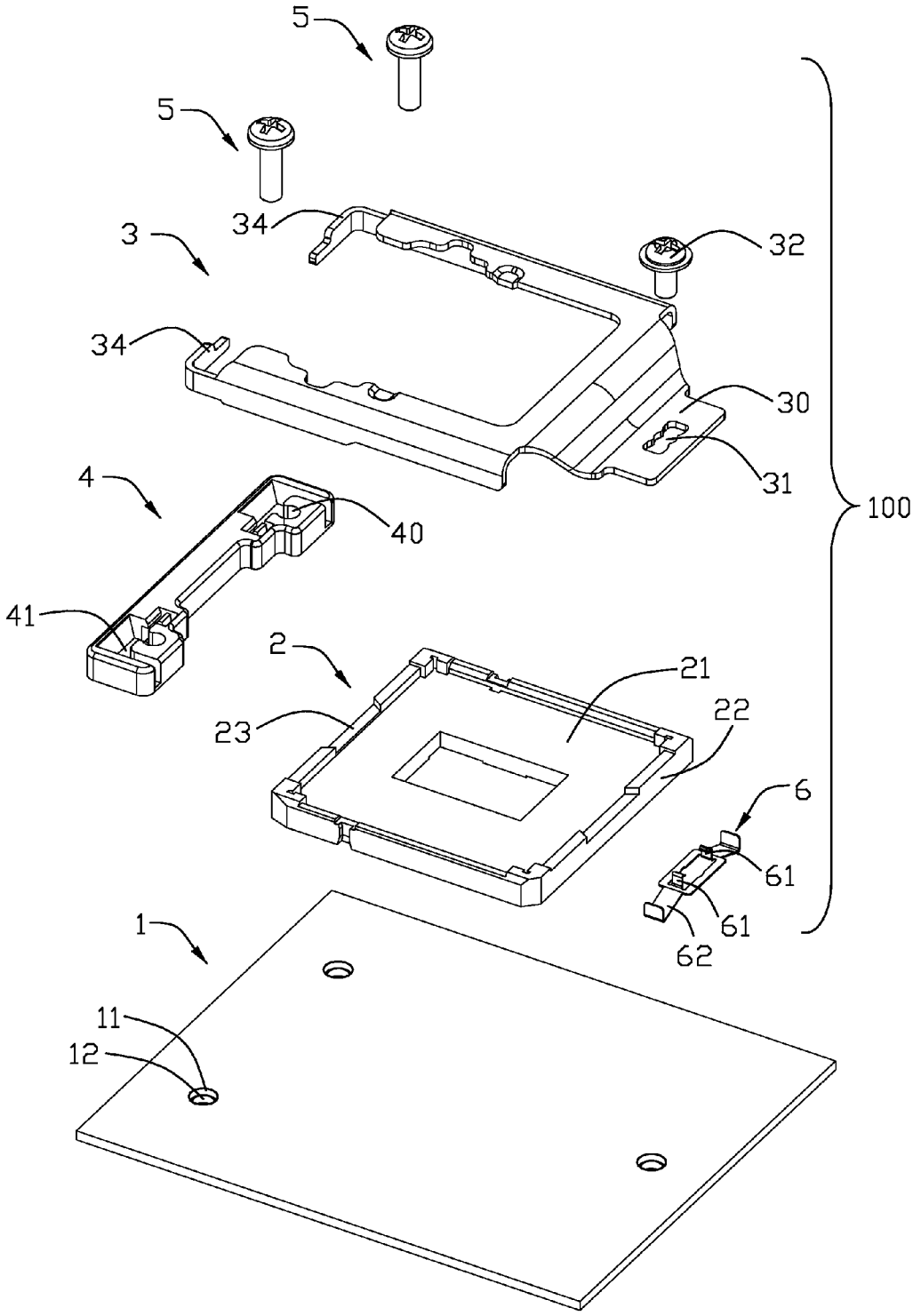
FIG. 2 is an exploded, perspective view of the electrical connector assembly shown in FIG. 1.
Figure 3:
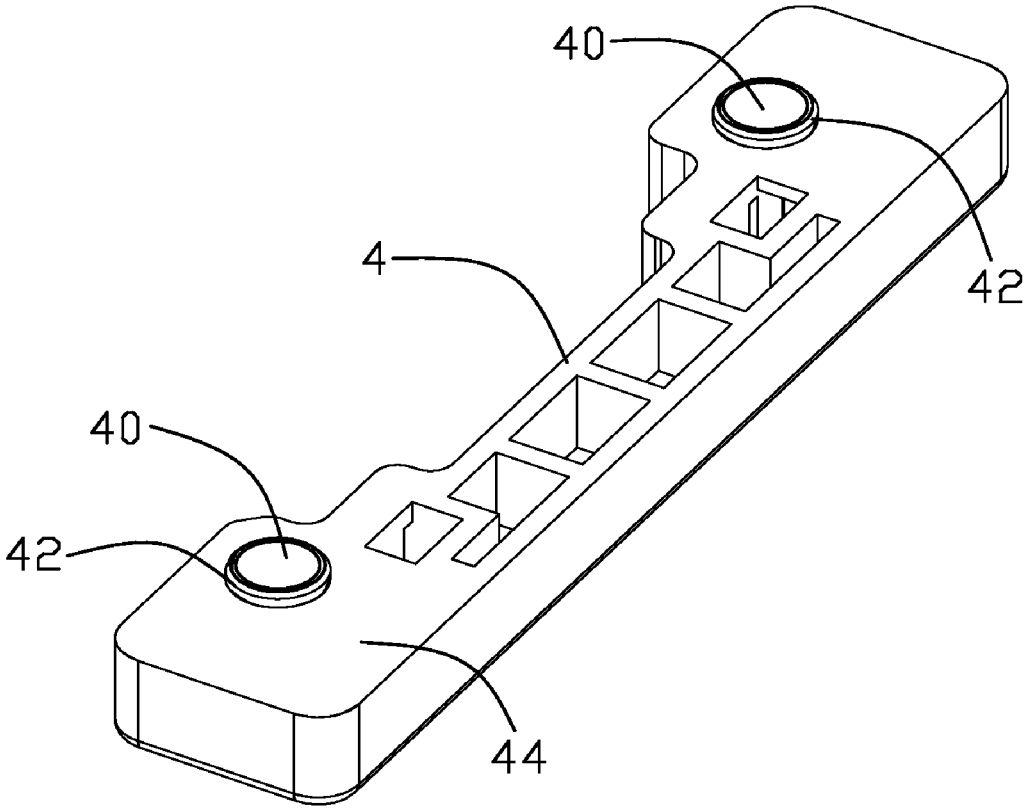
FIG. 3 is a perspective view of an insulator of the electrical connector assembly.

Referring to FIG. 1 to FIG. 3, an electrical connector assembly 100 of a first embodiment of the invention comprises an insulative housing 2, a plurality of contacts (not shown) received in the housing 2, an insulator 4 located at the front of the housing 2 and a shell 3 covering the insulative housing 2.

The insulative housing 2 comprises a main portion 21 and a plurality of side walls 22 located at four lateral sides of the main portion 21. The contacts are held on the main portion 21, which are soldered on the PCB 1 to secure the housing 2. The front side wall 22 and the rear side wall 22 set a pair of gaps 23 for receiving a pick up (not shown).

The insulator 4 is made from plastic material, which is separated with the insulative housing 2. The insulator 4 comprises a pair of mounting holes 40 located the opposite sides of the insulator 4 and a pair of retaining grooves 41 located at the front of the mounting holes 40. A pair of screws 5 pass through the mounting holes 40, the retaining holes 11 and the screw holes 12 and are assembled on the PCB finally. The retaining groove 41 is of L-shaped for receiving an end of the shell 3. The insulator 4 further comprises a bottom surface 44 and a pair of guiding portion 42 extending towards the PCB 1, and the guiding portion 42 is located at the bottom of the mounting hole 40, being of a circular shaped. The guiding portion 42 is received in the retaining hole 11 of the PCB 1 and the bottom surface 44 is attached to the PCB 1.

Referring to FIG. 1 to FIG. 2, the shell 3 is stamped from a metal piece and in a U-shape. The shell 3 has a tongue portion 30 extending in a front-to-back direction and defining a hole 31 for receiving a fastener 32. The fastener 32 passes through the hole 32 and the through hole of the PCB 2 to assemble the shell 3 on the PCB 1. Each lateral edge of the shell 3 has a pivotal portion 34 bent from a free end thereof and contained into the corresponding retaining groove 41 of the insulator 4 to pivotally assemble the shell 3 to the insulator 4 to cover the insulative housing 2. An indicator 6 is inserted to the tongue portion 30 from a bottom side, it comprises a pair of clips 61 and a pair of spring arms 62, the clips 61 passes though the hole 31 of the tongue portion 30 of the load plate 3 from a bottom side, and the spring arms 62 extend downwardly and are disposed between the tongue portion 30 and the PCB 1.

Figure 4:
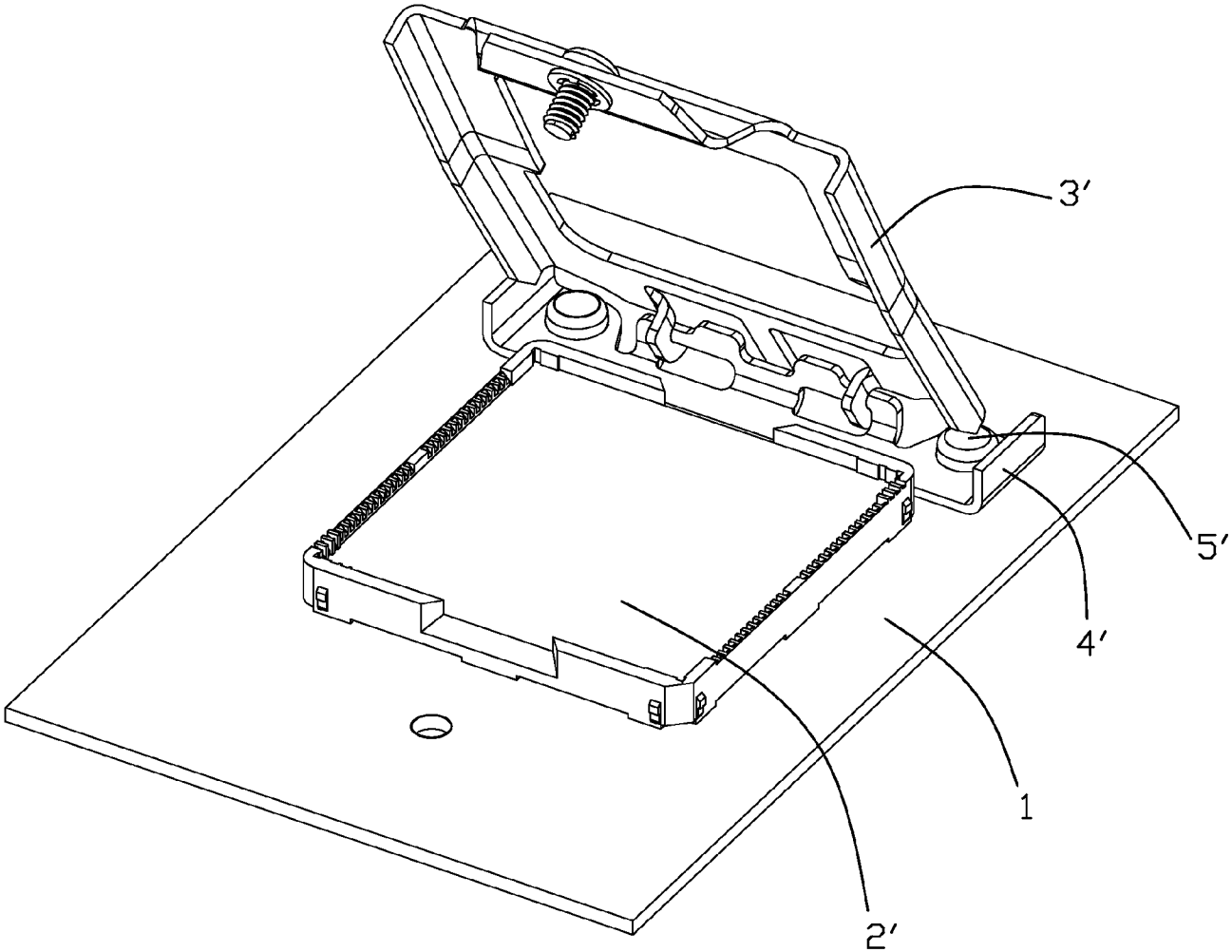
FIG. 4 is a perspective view of an electrical connector assembly according to a second embodiment of the invention.
Figure 5:
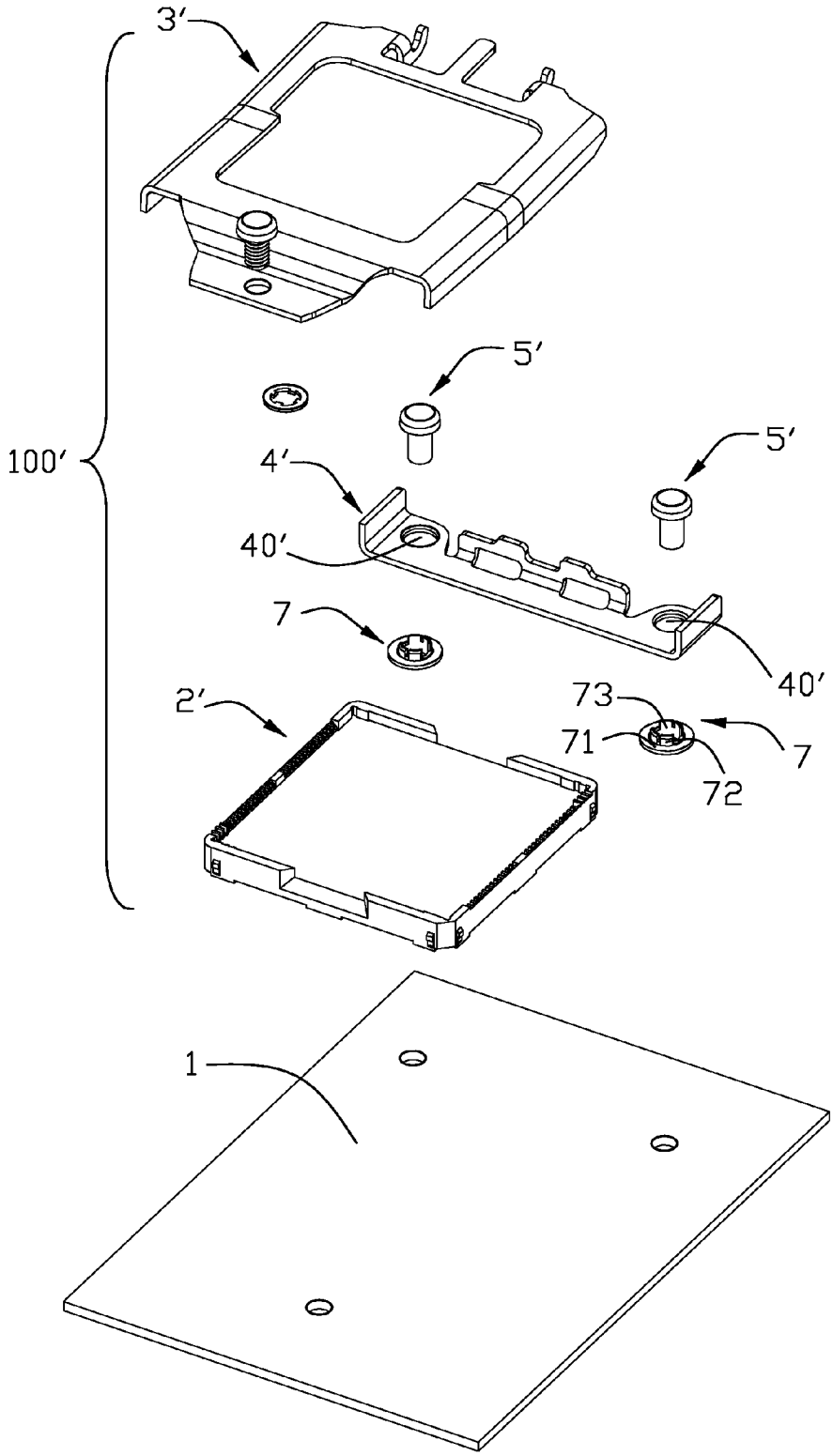
FIG. 5 is an exploded, perspective view of the electrical connector assembly shown in FIG. 4.
Figure 6:
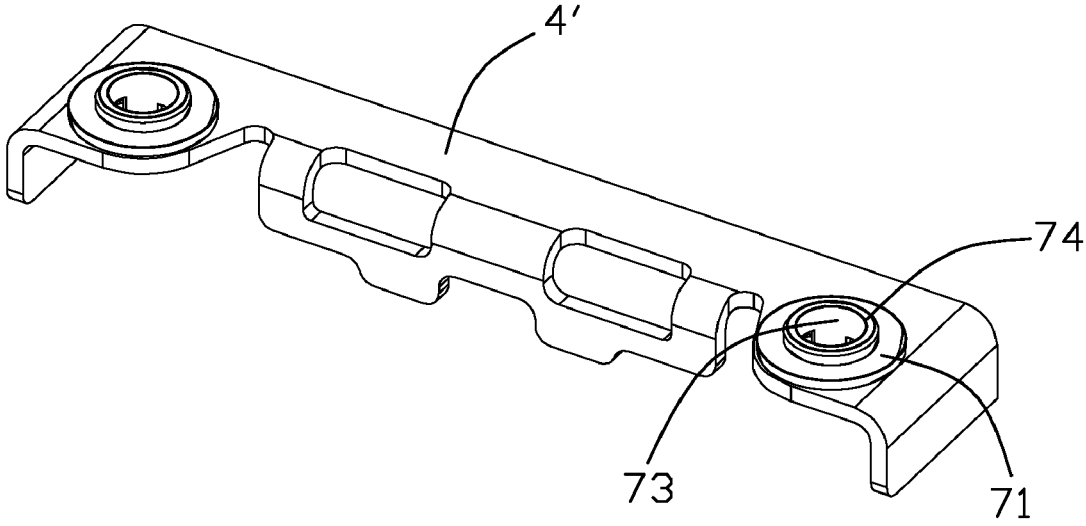
FIG. 6 is a perspective view of a partial structure of the electrical connector assembly shown in FIG. 4.

Referring to FIG. 4 to FIG. 6, an electrical connector assembly 100' of a second embodiment of the invention comprises an insulative housing 2', a plurality of contacts received in the housing 2', a connecting device 4' located at the front of the housing 2' and a shell 3' covering the housing 2'. The structure of the insulative housing 2' and the shell 3' in the second embodiment is the same to the first embodiment. The connecting device 4' is mounted at the front of the housing 2' and is stamped from a metal piece. The connecting device 4' comprises a pair of mounting hole 40'. To avoid the metallic connecting device 4' contacting with PCB 1' directly, a pair of washers 7 are assembled to the connecting device 4' as an insulator, each comprises a contacting face 71, an extending portion 72 extends upwardly form the contacting face 71, a mounting hole 73 and a guiding portion 74 located at the bottom of the contacting face 71. The contacting face 71 is attached to the PCB 1. The extending potion 72 is received in the mounting hole 40' to hold the washer 7 on the connecting device 4'. The guiding portion 74 is of a circular shaped, which is received in the retaining hole 11 of the PCB 1.

When the electrical connector 100, 100' is assembled on the PCB 1, the guiding portion 42, 74 are received in the retaining hole 11 of the PCB 1, then the mounting hole 40, 73 communicate with the screw hole 12 automatically. The guiding portion 42, 74 received in the retaining hole 11 also can prevent the insulator 4 or the connecting device 4' rotating around the screw 5', 5 when the screw 5, 5' are assembled to the PCB 1.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What is claimed is:

1. An electrical connector assembly comprising:

a PCB defining at least one retaining hole and at least one screw hole communicating with the retaining hole, the screw hole being located below the retaining hole; and an electrical connector comprising:

an insulative housing;

a plurality of contacts received in the insulative housing;

an insulator separated with the insulative housing, and comprising a bottom surface and a guiding portion extending downwardly from the bottom surface;

wherein the guiding portion is received in the at least one retaining hole of the PCB when the connector is assembled to the PCB, and the bottom surface of the insulator is attached to the PCB.

2. The electrical connector assembly as claimed in claim 1, wherein the insulator comprises a mounting hole, and the guiding portion is disposed opposite to mounting hole and is of a circular shape.

3. The electrical connector assembly as claimed in claim 1, wherein the diameter of the retaining hole is bigger than the diameter of the screw hole.

4. The electrical connector assembly as claimed in claim 3, wherein the insulator is located at the front of the insulative housing.

5. The electrical connector assembly as claimed in claim 4, wherein the insulator comprises a pair of retaining grooves located at the front of the mounting holes, the connector assembly further comprises a shell, and each lateral edge of the shell has a pivotal portion bent from a free end thereof and is retained in the corresponding retaining groove.

6. The electrical connector assembly as claimed in claim 1, wherein the insulator is an insulative washer.

7. The electrical connector assembly as claimed in claim 6, further comprising a connecting device located at the front of the insulative housing, wherein the connecting device is stamped from a metallic piece.

8. The electrical connector assembly as claimed in claim 7, wherein the washer is mounted between the connecting device and the PCB, and comprises an extending portion, and the connecting device has a mounting hole for receiving the extending portion.

9. An electrical connector comprising:

an insulative housing having a plurality of contacts therein;

a metallic shell downwardly covering said housing and defining a pivotal end region and a locking end region opposite to each other;

a through hole defined in said locking end region;

a fastener including a pole with an enlarged head downwardly extending through the through hole with the head downwardly seated upon the locking end region;

an indicator upwardly attached to an undersurface of the locking end region and defining a pair of clips upwardly extending through the through hole and grasping an upper face of the head of the fastener so as to have said fastener, said shell and said indicator assembled together.

10. The electrical connector as claimed in claim 9, wherein said indicator further includes at least one spring arm extending laterally below the undersurface of the locking end region with a tab at a distal end laterally outside of the locking end region.

11. An electrical connector assembly comprising:

a printed circuit board defining a first through hole;

an insulative housing positioned upon the printed circuit board;

a metallic shell covering said housing and defining opposite pivotal end and locking end thereof;

a metallic connection device positioned beside the housing and defining a second through hole;

a standoff including a flat ring section sandwiched between the connection device and the printed circuit board, an upper ring section extending above the flat ring section into the second through hole and a lower ring section extending under the flat ring section into the first through hole; and a fastener having a post extending through the upper ring section, the flat ring section and the lower ring section, and an enlarged head on top of said post.

12. The electrical connector assembly as claimed in claim 11, wherein the upper ring section is hooked to the connection device.

13. The electrical connector assembly as claimed in claim 11, wherein said head downward abuts against the upper ring section while being spaced from the connection device.

* * * * *